US009695706B2

(12) United States Patent
Uesugi et al.

(10) Patent No.: US 9,695,706 B2
(45) Date of Patent: Jul. 4, 2017

(54) VARIABLE NOZZLE TURBOCHARGERS

(71) Applicants: KABUSHIKI KAISHA TOYOTA JIDOSHOKKI, Kariya-shi, Aichi-ken (JP); TOYOTA JIDOSHA KABUSHIKI KAISHA, Toyota-shi, Aichi-ken (JP)

(72) Inventors: Tsuyoshi Uesugi, Kariya (JP); Hiroaki Ikegami, Toyota (JP)

(73) Assignees: KABUSHIKI KAISHA TOYOTA JIDOSHOKKI, Kariya-shi, Aichi-ken (JP); TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 497 days.

(21) Appl. No.: 14/277,949

(22) Filed: May 15, 2014

(65) Prior Publication Data

US 2014/0341719 A1 Nov. 20, 2014

(30) Foreign Application Priority Data

May 16, 2013 (JP) ..... 2013-104081

(51) Int. Cl.
*F01D 17/16* (2006.01)

(52) U.S. Cl.
CPC ..... *F01D 17/165* (2013.01); *F05D 2220/40* (2013.01)

(58) Field of Classification Search
CPC ..... F01D 17/165; F05D 2220/40
USPC ..... 60/605.1; 415/159, 160, 163–164; 417/407
See application file for complete search history.

(56) References Cited

U.S. PATENT DOCUMENTS 4,804,316 A * 2/1989 Fleury ..... F01D 17/165 415/134
6,419,464 B1 * 7/2002 Arnold ..... F01D 5/141 415/159
2004/0081567 A1 * 4/2004 Boening ..... F01D 17/165 417/406

FOREIGN PATENT DOCUMENTS

JP 61-1829 A 1/1986
JP 61-49002 U 4/1986
JP 61-126053 U 8/1986
JP 61-202641 U 12/1986

OTHER PUBLICATIONS

Communication dated Apr. 14, 2015, issued by the Japanese Patent Office in counterpart Japanese application No. 2013-104081.

* cited by examiner

*Primary Examiner* — Hoang Nguyen
(74) *Attorney, Agent, or Firm* — Sughrue Mion, PLLC

(57) ABSTRACT

Embodiments of the present invention may include a variable nozzle turbocharger having a variable nozzle mechanism. The variable nozzle mechanism has a unison ring and a drive arm. The unison ring adjusts a degree of opening of variable nozzles having nozzle vanes through rotation of the unison ring. The unison ring has a first fit-engagement groove. The first fit-engagement groove has a closing side surface of a concave arcuate shape and an opening side surface of a convex arcuate shape facing the closing side surface with a fixed groove width therebetween. A drive arm has a first fit-engagement portion engaged with the first fit-engagement groove so that the first fit-engagement portion is rotatable and movable in the radial direction of the unison ring. The first fit-engagement portion has a closing side contact surface of a convex arcuate shape that is able to contact the closing side surface.

3 Claims, 6 Drawing Sheets

VARIABLE NOZZLE TURBOCHARGERS

This application claims priority to Japanese patent application serial number 2013-104081, the contents of which are incorporated herein by reference.

BACKGROUND OF THE INVENTION

Field of the Invention

Embodiments of the present invention relate to variable nozzle turbochargers.

Description of the Related Art

A variable nozzle turbocharger is equipped with a variable nozzle mechanism. A typical variable nozzle mechanism includes variable nozzles having nozzle vanes and a unison ring. The variable nozzle mechanism adjusts the opening degree of the variable nozzles based on a rotation of the unison ring. Thus, the variable nozzle mechanism controls a flow velocity of exhaust gas to a turbine wheel. The unison ring is provided with a drive arm fit-engagement groove that extends radially. A drive arm for driving the unison ring has a fit-engagement portion that is engaged with the fit-engagement groove. The fit-engagement portion is rotatable, and is movable in the radial direction of the unison ring along the fit-engagement groove of the unison ring. Unison-ring/drive-arm engagement structures according to related-art examples 1 and 2 will be described with reference to FIGS. 8 and 9.

As shown in FIG. 8, a drive arm 1 of related-art example 1 has a first end (base end) and a second end (tip end). The first end is rotated around a pivot 2. The second end has a round fit-engagement portion 3. A fit-engagement groove 6 is formed in a unison ring 5 so as to cross it radially and straight. A closing side surface 6*a* is situated on the side of the fit-engagement groove 6 where the unison ring 5 decreases the opening degree of the variable nozzle. An opening side surface 6*b* is situated on the side of the fit-engagement groove 6 where the unison ring 5 increases the opening degree of the variable nozzle. The wall surfaces 6*a* and 6*b* are flat surfaces facing each other in parallel with a fixed groove width 6W therebetween.

As shown in FIG. 9, related-art example 2 has a fit-engagement groove 8 instead of the fit-engagement groove 6 of FIG. 8. The fit-engagement groove 8 has a closing side surface 8*a* and an opening side surface 8*b*. Japanese Laid-Open Utility Model Publication No. 61-49002 discloses a substantially semi-circular fit-engagement groove instead of the fit-engagement grooves 6 and 8. The pressure of exhaust gas, i.e., the so-called exhaust reaction force, acts on the nozzle vane. The exhaust reaction force is generally constantly generated from the variable nozzle side to the actuator side. Thus, the fit-engagement portion 3 of the drive arm 1 constantly contacts the closing side surface 6*a* or 8*a* of the fit-engagement groove 6 or 8.

In related-art example 2 of FIG. 9, the fit-engagement portion 3 and the wall surface 8*a* contact each other. Thus, an arcuate surface contacts another arcuate surface. On the other hand, in related-art example of FIG. 8, the fit-engagement portion 3 and the wall surface 6*a* contact each other. Thus, an arcuate surface contacts a flat surface. As compared with related-art example 2, in related-art example 1, the contact area is smaller, and the contact stress is larger. As a result, the wall surface 6*a* of related-art example 1 is more subject to wear than the wall surface 8*a* of related-art example 2.

In related-art example 2 of FIG. 9, arcuate surfaces contact each other. As compared with related-art example 1 of FIG. 8, the contact stress is reduced. As a result, the wear of the wall surface 8*a* of related-art example 2 is reduced. However, it is impossible to form simultaneously on both wall surfaces 8*a* and 8*b* by using a rotary tool such as an end mill. Thus, it is necessary to form on the wall surfaces 8*a* and 8*b* separately. The groove width of the fit-engagement hole 8 is not fixed in the radial direction of the unison ring 5. Thus, control operations such as dimension measurement are not easy to perform. Accordingly, deterioration in productivity and reliability is inevitable.

According to the disclosure in Japanese Laid-Open Utility Model Publication No. 61-49002, the fit-engagement groove (communication fit-engagement groove) has a substantially semi-circular configuration. However, from the viewpoint of the engagement relationship with respect to the fit-engagement portion of the drive arm, it is to be presumed that the fit-engagement groove has a U-shaped configuration. Thus, also in the technique disclosed in the above-mentioned publication, a problem similar to that of related-art example 1 is involved.

In the variable nozzle mechanism, the fit-engagement portion of the drive arm contacts the closing side surface of the fit-engagement groove of the unison ring. There is a need in the art for a variable nozzle turbocharger in which the contact stress is low and which has high productivity or high reliability.

SUMMARY OF THE INVENTION

According to an aspect of the invention, certain embodiments of the present invention include a variable nozzle turbocharger having a variable nozzle mechanism for controlling a flow velocity of exhaust gas to a turbine wheel. The variable nozzle mechanism has a unison ring and a drive arm. The unison ring adjusts the degree of opening for a plurality of variable nozzles having nozzle vanes through rotation of the unison ring. The unison ring has a first fit-engagement groove extending in the radial direction. The first fit-engagement groove has a closing side surface of a concave arcuate shape and an opening side surface of a convex arcuate shape facing the closing side surface with a fixed groove width therebetween. A drive arm has a first fit-engagement portion which is engaged with the first fit-engagement groove so as to be rotatable and movable in the radial direction of the unison ring. The first fit-engagement portion has a closing side contact surface of a convex arcuate shape that is able to contact the closing side surface.

The closing side surface of the fit-engagement groove of the unison ring has a concave arcuate shape. Using such a shape, it is possible to reduce the contact stress between the closing side surface and the fit-engagement portion. More specifically, the contact stress between the closing side surface of the fit-engagement groove and the fit-engagement portion can be reduced as they are constantly in contact with each other. In this manner, it is possible to reduce the wear of the closing side surface caused by the exhaust reaction force.

The opening side surface of the fit-engagement groove has a convex arcuate shape. The opening side surface faces the closing side surface with the fixed groove width therebetween. Thus, it is possible to machine the fit-engagement groove in the unison ring easily and accurately by using a rotary tool such as an end mill. In this manner, it is possible to achieve an improvement in terms of productivity and reliability. Due to the exhaust reaction force, the opening side surface of the fit-engagement groove and the fit-engagement portion of the drive arm are normally spaced away from each other. Thus, even if the opening side surface has a convex arcuate shape, the contact stress between the opening side surface and the fit-engagement portion does not increase.

In another aspect of the invention, the unison ring has a plurality of radially extending second fit-engagement grooves. Each second fit-engagement groove has a closing side surface of a concave arcuate shape and an opening side surface of a convex arcuate shape facing the closing side surface with a fixed groove width therebetween. Each variable nozzle has a second fit-engagement portion to be engaged with each second fit-engagement groove so as to be rotatable and movable in the radial direction of the unison ring along the second fit-engagement groove. Each second fit-engagement portion has a convex arcuate shape that is able to contact the closing side surface of the second fit-engagement groove.

The closing side surface of the second fit-engagement groove of the unison ring has a concave arcuate shape. Using such a shape, it is possible to reduce the contact stress between the closing side surface of the second fit-engagement groove and the fit-engagement portion. More specifically, the contact stress between the closing side surface of the arm and the fit-engagement portion can be reduced as they are constantly in contact with each other. In this manner, it is possible to reduce the wear of the closing side surface caused by the exhaust reaction force.

The opening side surface of the second fit-engagement groove has a convex arcuate shape. The opening side surface faces the closing side surface with the fixed groove width therebetween. Thus, it is possible to create the second fit-engagement groove in the unison ring easily and accurately by using a rotary tool such as an end mill. In this manner, it is possible to achieve an improvement in terms of productivity and reliability. Due to the exhaust reaction force, the opening side surface of the second fit-engagement groove and the fit-engagement portion of the drive arm are normally spaced away from each other. Thus, even if the opening side surface has a convex arcuate shape, the contact stress between the opening side surface and the fit-engagement portion does not increase.

DETAILED DESCRIPTION OF THE INVENTION

Each of the additional features and teachings disclosed above and below may be utilized separately or in conjunction with other features and teachings to provide improved variable nozzle turbochargers. Representative examples of the present invention, which utilize many of these additional features and teachings both separately and in conjunction with one another, will now be described in detail with reference to the attached drawings. This detailed description is merely intended to teach a person of ordinary skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful configurations of the present teachings.

Figure 1:
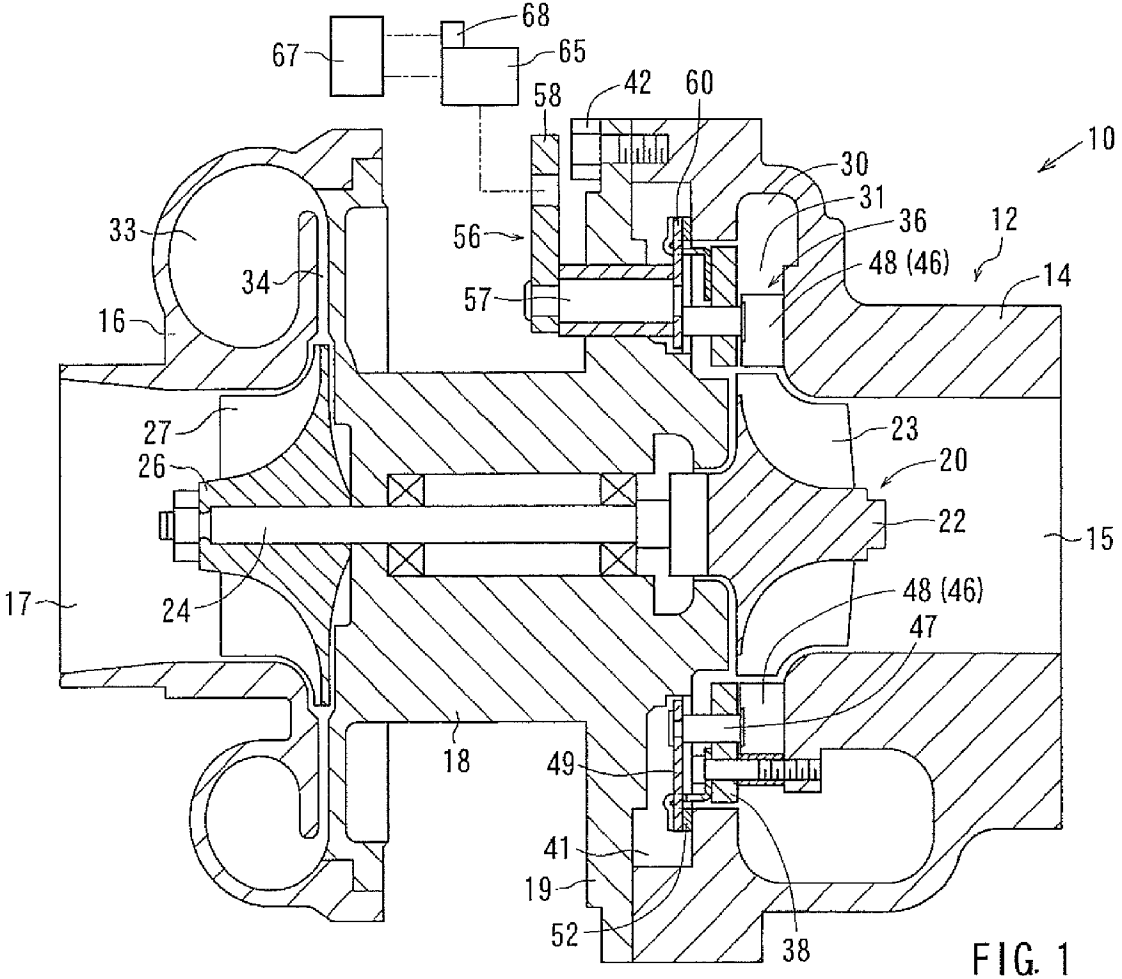
FIG. 1 is a cross-sectional view of a variable nozzle turbocharger.

As shown in FIG. 1, a variable nozzle turbocharger 10 has a rotor housing 12 rotatably accommodating a rotor 20. The rotor housing 12 includes a turbine housing 14, a compressor housing 16, and a center housing 18 connecting the two housings 14 and 16.

The rotor 20 has a turbine wheel 22, a rotor shaft 24 integral with the turbine wheel 22, and a compressor wheel 26 mounted to an end of the rotor shaft 24. The rotor shaft 24 is rotatably supported with respect to the center housing 18. The turbine wheel 22 has a plurality of blades 23 on the outer peripheral portion thereof. The turbine wheel 22 is arranged in the turbine housing 14. The compressor wheel 26 has a plurality of blades 27 on the outer peripheral portion thereof. The compressor wheel 26 is arranged in the compressor housing 16.

A spiral scroll path 30 is formed in the turbine housing 14. An annular whirling path 31 facing the blades 23 of the turbine wheel 22 is open in the scroll path 30. The scroll path 30 communicates with a discharge path for exhaust gas discharged from the combustion chamber of an internal combustion engine (not shown). After flowing into the scroll path 30, the exhaust gas is blown toward the blades 23 of the turbine wheel 22 from the whirling path 31. The exhaust gas is discharged from a discharge port 15 of the turbine housing 14 via rotation of the turbine wheel 22. The scroll path 30 and the whirling path 31 form an exhaust flow path for the exhaust gas to flow to the turbine wheel 22.

A spiral compressor path 33 is formed in the compressor housing 16. An annular send-out path 34 facing the blades 27 of the compressor wheel 26 is open in the compressor path 33. The compressor path 33 communicates with the combustion chamber of the internal combustion engine via an intake path (not shown). The compressor wheel 26 rotates integrally with the rotation of the turbine wheel 22. The compressor wheel 26 compresses the intake air introduced from an intake air inlet 17 of the compressor housing 16 via the blades 27, and sends it out to the send-out path 34 using centrifugal action. The air discharged into the send-out path 34 is supercharged to the combustion chamber of the internal combustion engine via the compressor path 33.

The variable nozzle turbocharger 10 is provided with a variable nozzle mechanism 36 in the whirling path 31 of the turbine housing 14. The variable nozzle mechanism 36 controls the flow velocity of the exhaust gas as it passes to the turbine wheel 22. An annular nozzle ring 38 (housing member) is arranged for setting the variable nozzle mechanism 36. The nozzle ring 38 is provided in the turbine housing 14 near the center housing 18, and constitutes the side wall of the whirling path 31. The nozzle ring 38 is fixed to the turbine housing 14 by a plurality of (e.g., four) connection bolts.

An annular space portion 41 is formed between the turbine housing 14 and the center housing 18. The annular space portion 41 is arranged outside of the center housing 18. The nozzle ring 38 divides the annular space portion 41 and the whirling path 31. The center housing 18 is provided with a flange (side wall portion) 19 on the outer peripheral portion thereof. The flange 19 forms the annular space portion 41. The flange 19 is fixed to the turbine housing 14 by bolts 42. Retaining rollers 44 (See FIG. 2) are arranged on the surface of the nozzle ring 38 facing the annular space portion 41. Each of the retaining roller 44 is rotatably retained on the nozzle ring 38 by a pin arranged at the central portion thereof. The retaining rollers 44 rotatably retain a unison ring 52.

Figure 2:
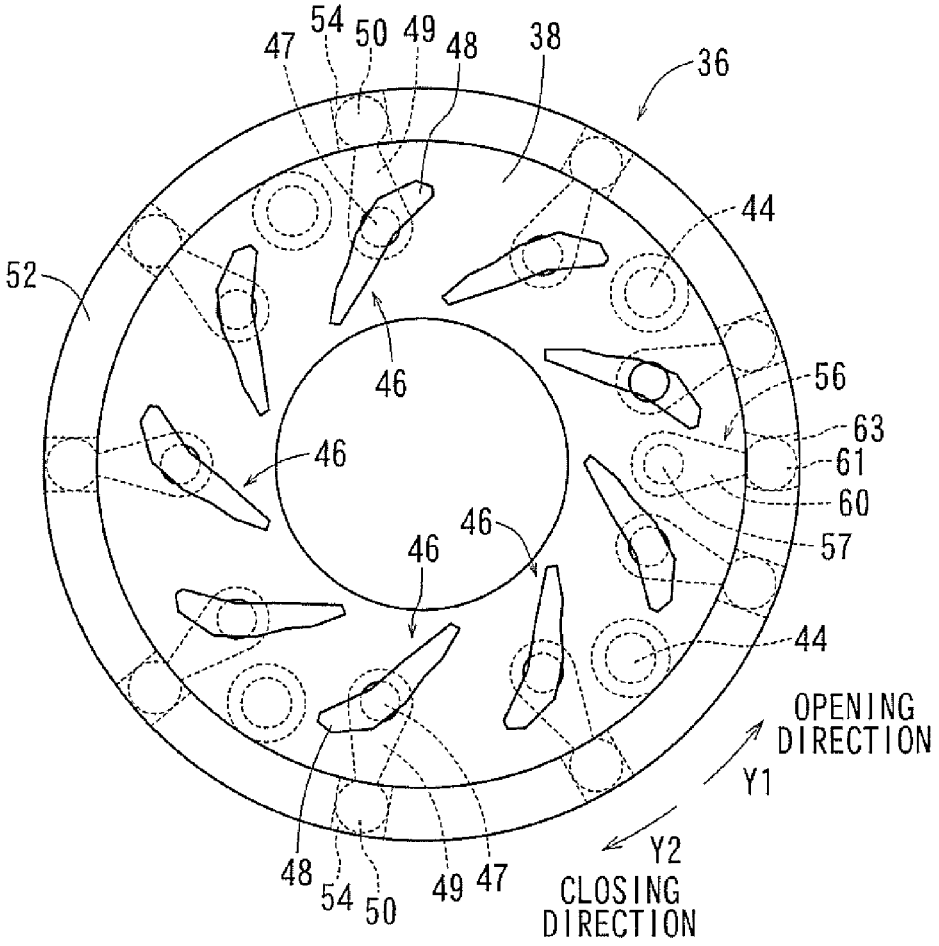
FIG. 2 is a schematic view of a variable nozzle mechanism having variable nozzles shown from the side of the nozzle vanes.
Figure 3:
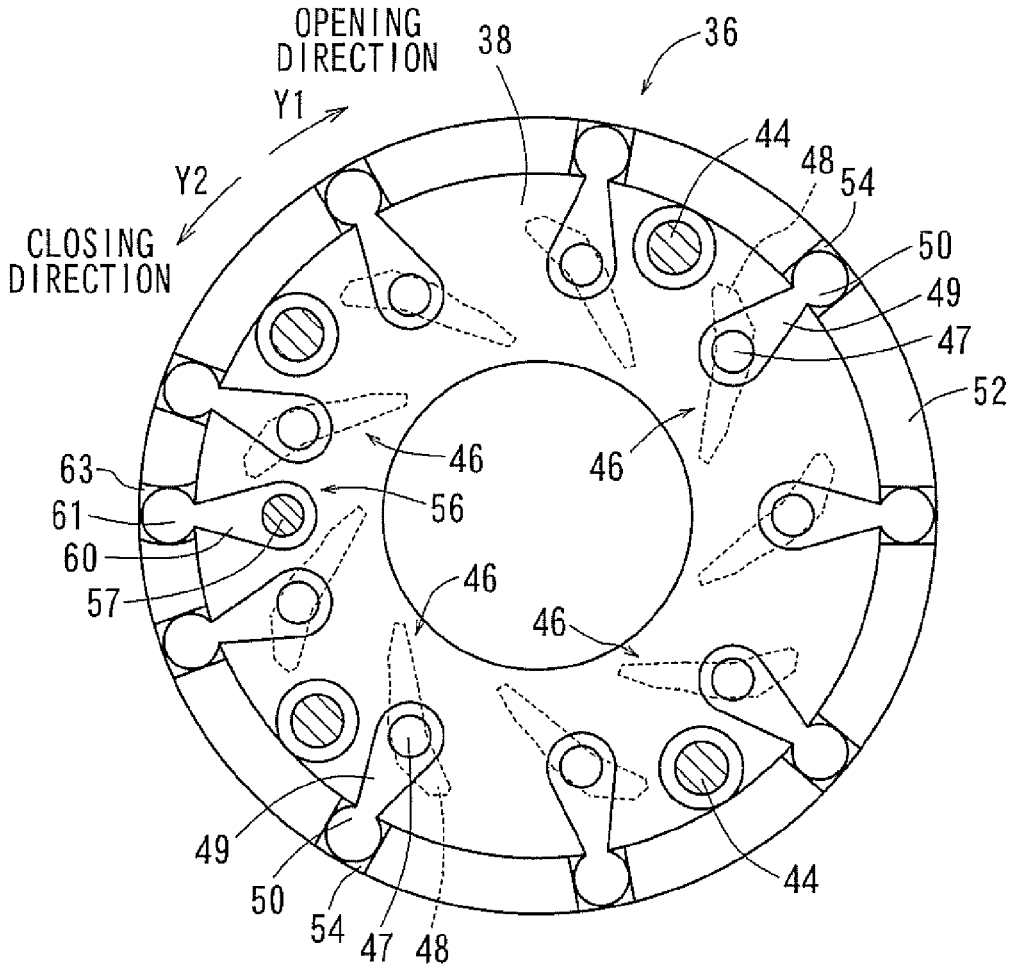
FIG. 3 is a schematic view of the variable nozzle mechanism having the variable nozzles shown from the side of the arms.

As shown in FIGS. 2 and 3, the variable nozzle mechanism 36 is provided with a plurality of (e.g., nine) variable nozzles 46. Each variable nozzle 46 has a pivot 47, a nozzle vane 48 fixedly provided at one end of the pivot 47 and an arm 49 fixedly mounted to the other end of the pivot 47. The pivot 47 is rotatably supported in the nozzle ring 38. The pivot 47 rotatably supports the variable nozzle 46 with respect to the nozzle ring 38. The variable nozzles 46 are arranged on the nozzle ring 38 at equal circumferential intervals. A round fit-engagement portion 50 is formed at an end of each arm 49. The nozzle vanes 48 are rotatably arranged in the whirling path 31. The nozzle vanes 48 can open and close the whirling path 31. The arms 49 are rotatably arranged in the annular space portion 41 (See FIG. 1).

As shown in FIG. 1, the annular unison ring 52 is arranged in the annular space portion 41. The unison ring 52 is arranged concentrically with the nozzle ring 38. The unison ring 52 is axially deviated from the nozzle ring 38, and is arranged closer to the flange 19 of the center housing 18 than the nozzle ring 38. The retaining rollers 44 retain the unison ring 52 so that the unison ring 52 can rotate around the axis with respect to the turbine housing 14. The unison ring 52 rotates at surrounding of the nozzle ring 38. The unison ring 52 is arranged between the nozzle ring 38 and the arms 49.

As shown in FIG. 3, the unison ring 52 has a first surface facing the arms 49 of the variable nozzles 46. Arm fit-engagement grooves 54 are formed in the first surface at equal circumferential intervals. The number of arm fit-engagement grooves 54 is preferably the same as the number of variable nozzles 46. The fit-engagement portions 50 of the arms 49 are rotatably engaged with the arm fit-engagement grooves 54. The fit-engagement portions 50 are movable in the radial direction of the unison ring 52 along the arm fit-engagement grooves 54.

As shown in FIG. 1, a unison ring drive member 56 is provided on the flange 19 of the center housing 18. The drive member 56 has a pivot 57, a drive lever 58, and a drive arm 60. The pivot 57 is rotatably supported with respect to the flange 19. The pivot 57 rotatably supports the drive member 56 with respect to the flange 19. The drive lever 58 is fixedly mounted to an end of the pivot 57. The drive lever 58 is rotatably arranged outside the annular space portion 41. The drive arm 60 is fixedly mounted to the other end of the pivot 57. The drive arm 60 is rotatably accommodated in the annular space portion 41. A round fit-engagement portion 61 (See FIG. 3) is formed at an end of the drive arm 60.

As shown in FIG. 3, the unison ring 52 has a first surface facing the arms 49 of the variable nozzles 46. A drive arm fit-engagement groove 63 is formed in the first surface. The fit-engagement groove 63 is situated between a pair of adjacent arm fit-engagement grooves 54. The fit-engagement portion 61 of the drive arm 60 is rotatably engaged with the fit-engagement groove 63. The fit-engagement portion 61 is movable in the radial direction of the unison ring 52 along the fit-engagement groove 63. Together with the drive lever 58, the drive arm 60 rotates around the pivot 57. As a result, the unison ring 52 rotates. The arms 49 of the variable nozzles 46 and the drive arm 60 are the same or have substantially the same configuration.

As shown in FIG. 1, the output portion (not shown) of an actuator 65 is connected to the drive lever 58. Through the operation of the actuator 65, the drive lever 58 rotates. The actuator 65 may consist, for example, of an electric motor, an electromagnetic solenoid, or an air cylinder. The actuator 65 may be provided on the rotor housing 12. The actuator 65 is drive-controlled by a controller 67. The actuator 65 is provided with an operation amount detection sensor (unit) 68 such as an angle sensor for detecting the operation amount of the output portion. Based on the output of the operation amount detection sensor 68, the controller 67 calculates the rotation angle, i.e., the opening degree, of the variable nozzles 46. Thus, the operation amount detection sensor 68 is used as an operation degree detection unit (sensor) for detecting the opening degree of the variable nozzles 46. Between the output portion of the actuator 65 and the drive arm 60 of the drive member 56, there may be provided a power transmission mechanism such as a link mechanism or a gear mechanism.

The controller 67 operates the actuator 65. Then, the drive member 56 is rotated. As a result, the unison ring 52 rotates, causing the plurality of variable nozzles 46 to rotate in synchronization with each other. For example, in FIG. 3, when the unison ring 52 rotates to the right (as indicated by the arrow Y1 in the drawing), all the variable nozzles 46 rotate in the opening direction around the axes of the pivots 47. In this way, through the rotation of the unison ring 52, all the variable nozzles 46 rotate in synchronization with each other. The nozzle vanes 48 are opened/closed, and the opening degree of the variable nozzles 46, more specifically, the nozzle vanes 48, are adjusted. The flow path sectional area between the mutually adjacent nozzle vanes 48 are increased or decreased. As a result, the flow velocity of the exhaust gas to the turbine wheel 22 is controlled.

The variable nozzles 46, the unison ring 52, the drive member 56 and the actuator 65 constitute the variable nozzle mechanism 36. The arms 49 of the variable nozzles 46 and the unison ring 52 are connected together as a power transmission route. The unison ring 52 and the drive arm 60 of the drive member 56 are connected together as a power transmission route. The drive lever 58 of the drive member 56 and the output portion of the actuator 65 are connected together as a power transmission route.

Figure 4:
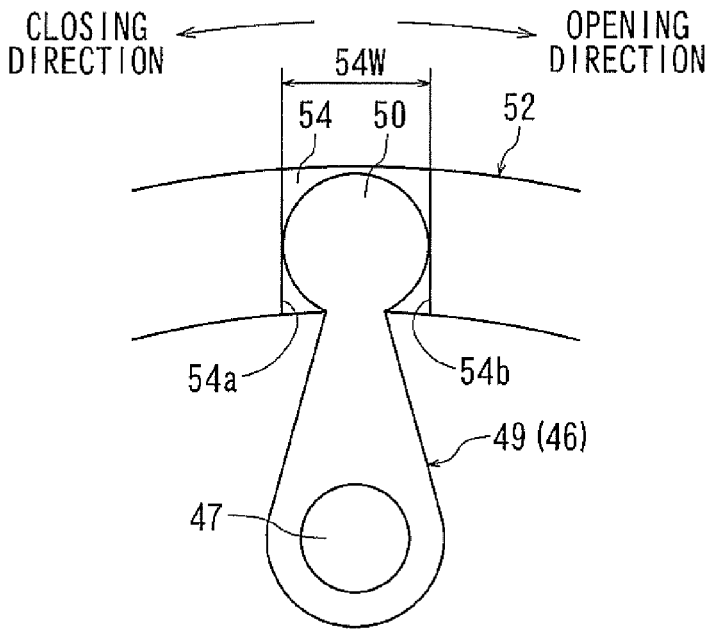
FIG. 4 is a schematic view for showing the arm of the variable nozzle engaged with a unison ring.

As shown in FIG. 4, the fit-engagement portion 50 of the arm 49 of each variable nozzle 46 has a round configuration. Each arm fit-engagement groove 54 of the unison ring 52 crosses the unison ring 52 straight in the radial direction. In each arm fit-engagement groove 54, a closing side surface 54*a* and an opening side surface 54*b* face each other in parallel with a groove width 54W therebetween. The closing side surface 54*a* is situated on the closing side of the unison ring 52. The opening side surface 54*b* is situated on the opening side of the unison ring 52. The groove width 54W of the arm fit-engagement groove 54 is slightly larger than the diameter of the fit-engagement portion 50 of the arm 49. The arm fit-engagement groove 54 is formed by the processing of the unison ring 52 through using a rotary tool such as an end mill. The outer peripheral surface of the fit-engagement portion 50 includes a closing side contact surface for contacting the closing side surface 54*a*.

Figure 5:
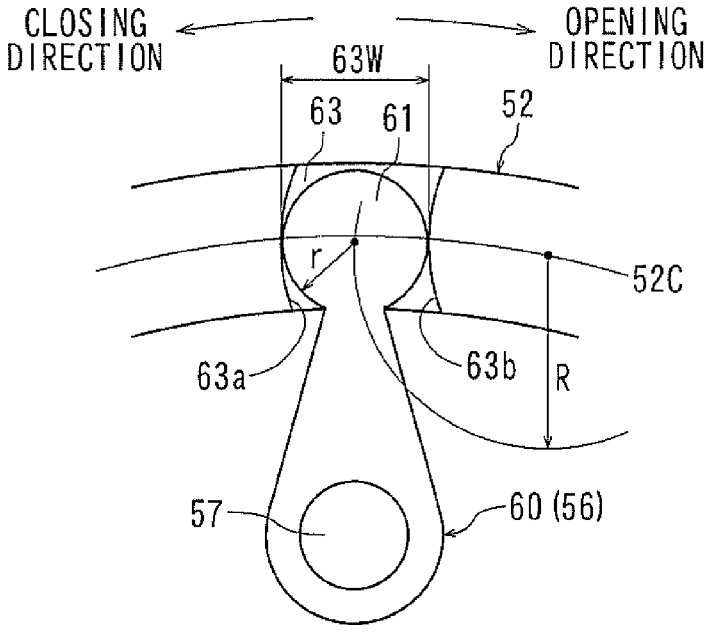
FIG. 5 is a schematic view for showing a drive arm engaged with the unison ring.

The main portion of the variable nozzle mechanism 36 includes the engagement structure of the unison ring 52 and the drive arm 60. FIG. 5 illustrates the engagement structure of the unison ring 52 and the drive arm 60.

As shown in FIG. 5, the fit-engagement portion 61 of the drive arm 60 has a round shape. In the first surface of the unison ring 52, the fit-engagement grove 63 extends in the radial direction while being curved. In the fit-engagement groove 63, the unison ring 52 has a closing side surface 63*a* and an opening side surface 63*b*. The closing side surface 63*a* and the opening side surface 63*b* face each other with a groove width 63W therebetween. The closing side surface 63*a* is situated on the closing side in the fit-engagement groove 63, and has a concave arcuate shape. The opening side surface 63*b* is situated on the opening side in the fit-engagement groove 63, and has a convex arcuate shape. The groove width 63W of the fit-engagement groove 63 is slightly larger than the diameter of the fit-engagement portion 61 of the drive arm 60. The fit-engagement groove 63 is formed by the creation of the unison ring 52 using a rotary tool such as an end mill.

The fit-engagement groove 63 has a central portion between the closing side surface 63*a* and the opening side surface 63*b*. A machining center line of a radius of curvature R passes the central portion. The fit-engagement portion 61 of the drive arm 60 has a radius r. The radius of curvature R is set so as to satisfy the following condition: $1r<R<3r$. The center of the radius of curvature R is situated in the circumferential line 52C in FIG. 5. The centers of the closing side surface 63*a* and of the opening side surface 63*b* are also situated in the circumferential line 52C. The outer peripheral surface of the fit-engagement portion 61 includes a closing side contact surface for contacting the closing side surface 63*a* of the fit-engagement groove 63.

As described above, the closing side surface 63*a* of the fit-engagement groove 63 of the unison ring 52 has a concave arcuate shape. Using such a shape, it is possible to reduce the contact stress between the closing side surface 63*a* and the fit-engagement portion 61. More specifically, the contact stress between the closing side surface 63*a* of the fit-engagement groove 63 and the fit-engagement portion 61 can be reduced as they are constantly in contact with each other. In this manner, it is possible to reduce the wear of the closing side surface 63*a* caused by the exhaust reaction force.

The opening side surface 63*b* of the fit-engagement groove 63 has a convex arcuate shape. The opening side surface 63*b* faces the closing side surface 63*a* with a fixed groove width 63W therebetween. Thus, it is possible to machine the fit-engagement groove 63 in the unison ring 52 easily and accurately by using a rotary tool such as an end mill. In this manner, it is possible to achieve an improvement in terms of productivity and reliability. Due to the exhaust reaction force, the opening side surface 63*b* of the fit-engagement groove 63 and the fit-engagement portion 61 of the drive arm 60 are normally spaced away from each other. Thus, even if the opening side surface 63*b* has a convex arcuate shape, the contact stress between the opening side surface 63*b* and the fit-engagement portion 61 does not increase.

Figure 6:
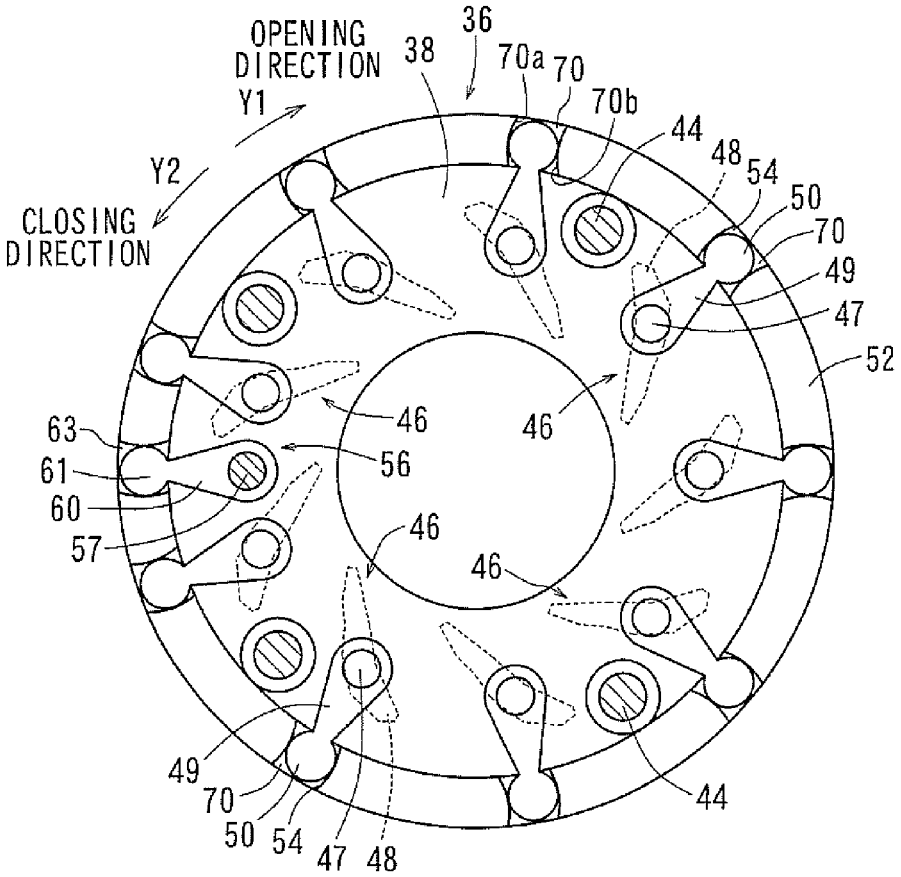
FIG. 6 is a schematic view of another variable nozzle mechanism having the variable nozzles shown from the side of the arms.

The unison ring 52 may be provided with at least one arm fit-engagement groove 70 shown in FIG. 6 rather than the arm fit-engagement groove 54 shown in FIGS. 3 and 4. The arm fit-engagement groove 70 has the same or substantially the same shape as the fit-engagement groove 63 shown in FIG. 5. In the arm fit-engagement groove 70, the unison ring 52 has a closing side surface 70*a* and an opening side surface 70*b*. In the arm fit-engagement groove 70, the closing side surface 70*a* is situated on the closing side, and has a concave arcuate shape. In the arm fit-engagement groove 70, the opening side surface 70*b* is situated on the opening side, and has a convex arcuate shape. The closing side surface 70*a* and the opening side surface 70*b* face each other with a fixed groove width therebetween. The groove width of the arm fit-engagement groove 70 is slightly larger than the diameter of the fit-engagement portion 50 of the arm 49. The arm fit-engagement groove 70 is formed by the creation of the unison ring 52 using a rotary tool such as an end mill.

As described above, the closing side surface 70*a* of the arm fit-engagement groove 70 of the unison ring 52 has a concave arcuate shape. Using such a shape, it is possible to reduce the contact stress between the closing side surface 70*a* and the fit-engagement portion 50. More specifically, the contact stress between the closing side surface 70*a* of the arm fit-engagement groove 70 and the fit-engagement portion 50 can be reduced as they are constantly in contact with each other. In this manner, it is possible to reduce the wear of the closing side surface 70*a* caused by the exhaust reaction force.

The opening side surface 70*b* of the arm fit-engagement groove 70 has a convex arcuate shape. The opening side surface 70*b* faces the closing side surface 70*a* with a fixed groove width therebetween. Thus, it is possible to create the arm fit-engagement groove 70 in the unison ring 52 easily and accurately by using a rotary tool such as an end mill. In this manner, it is possible to achieve an improvement in terms of productivity and reliability. Due to the exhaust reaction force, the opening side surface 70*b* of the arm fit-engagement groove 70 and the fit-engagement portion 50 of the arm 49 are normally spaced away from each other. Thus, even if the opening side surface 70*b* has a convex arcuate shape, the contact stress between the opening side surface 70*b* and the fit-engagement portion 50 does not increase.

While the embodiments of invention have been described with reference to specific configurations, it will be apparent to those skilled in the art that many alternatives, modifications and variations may be made without departing from the scope of the present invention. Accordingly, embodiments of the present invention are intended to embrace all such alternatives, modifications and variations that may fall within the spirit and scope of the appended claims. For example, embodiments of the present invention should not be limited to the representative configurations, but may be modified, for example, as described below.

Figure 7:
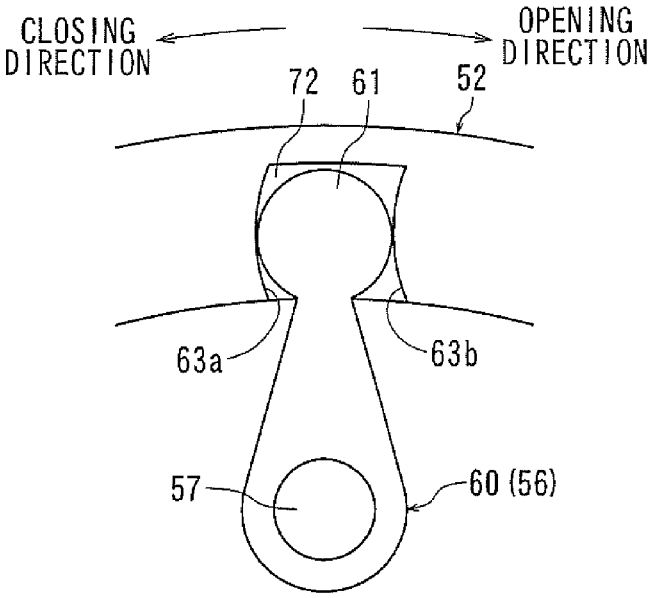
FIG. 7 is a schematic view for showing the drive arm engaged with the unison ring having another configuration.
Figure 8:
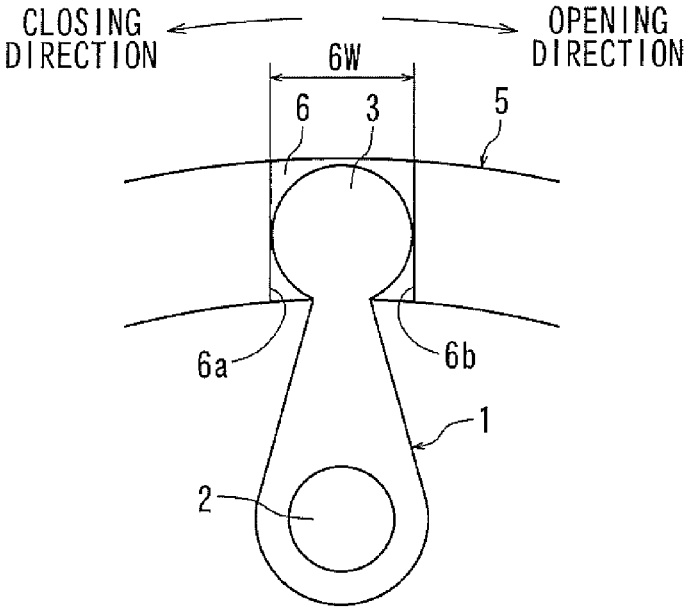
FIG. 8 PRIOR ART
FIG. 8 is a schematic view for showing a drive arm engaged with a unison ring according to an example in the prior art.
Figure 9:
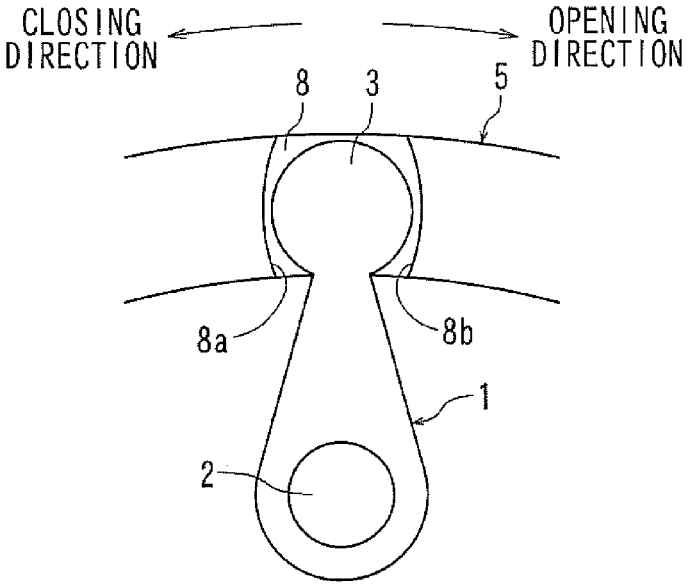
FIG. 9 PRIOR ART
FIG. 9 is a schematic view for showing the drive arm engaged with a unison ring according to another example in the prior art.

The unison ring 52 may have the drive arm fit-engagement groove 72 shown in FIG. 7 rather than the fit-engagement groove 63 shown in FIG. 5. The fit-engagement groove 72 has a closed outer peripheral end surface. The fit-engagement groove 72 has a closing side surface 63*a* and an opening side surface 63*b* formed in a same manner as those of the fit-engagement groove 63 of FIG. 5.

As described above, the fit-engagement portion 61 of the drive arm 60 includes a closing side contact surface having a convex arcuate shape. The closing side contact surface contacts the closing side surface 63*a* of the fit-engagement groove 63. The fit-engagement portion 61 may have a round shape which includes the closing side contact surface or some other configuration which includes the closing side contact surface. The fit-engagement portion 61 may have a columnar, a cylindrical, or a pin-like configuration.

As described above, the fit-engagement portion 50 of the arm 49 includes a closing side contact surface having a convex arcuate shape. The closing side contact surface contacts the closing side surface 54*a*, 70*a* of the arm fit-engagement groove 54, 70. The fit-engagement portion 50 may have a round shape which includes the closing side contact surface, or some other configuration which includes the closing side contact surface. The fit-engagement portion 50 may have a columnar, a cylindrical, or a pin-like configuration.

As described above, the arm fit-engagement groove 54, 70 and the fit-engagement groove 63, 72 may be formed by the creation of the unison ring 52 using a rotary tool such as an end mill. Alternatively, the arm fit-engagement groove 54, 70 and the fit-engagement groove 63, 72 may be formed by some other machining method or forming method such as press work or precision investment casting.

This invention claims:

1. A variable nozzle turbocharger comprising:

a variable nozzle mechanism for controlling a flow velocity of exhaust gas to a turbine wheel, the variable nozzle mechanism having a unison ring, a drive arm, and a plurality of variable nozzles having nozzle vanes, the unison ring configured to adjust a degree of opening of the plurality of variable nozzles through rotation of the unison ring, the unison ring having a first surface facing the variable nozzles, the first surface having a first fit-engagement groove formed in the first surface and extending from the first surface in a radial direction, the first fit-engagement groove having a closing contact side surface of a concave arcuate shape and an opening side surface of a convex arcuate shape facing the closing side surface with a fixed groove width therebetween, the drive arm having a first fit-engagement portion engaged with the first fit-engagement groove so that the first fit-engagement portion is rotatable and movable in the radial direction of the unison ring along the first fit-engagement groove; and the first fit-engagement portion having a closing side contact surface of a convex arcuate shape that is able to contact the closing side surface of the first fit-engagement groove.

2. The variable nozzle turbocharger of claim 1, wherein the unison ring has a plurality of radially extending second fit-engagement grooves formed in the first surface, and wherein each of the second fit-engagement grooves has a closing side surface of a concave arcuate shape and an opening side surface of a convex arcuate shape facing the closing side surface with a fixed groove width therebetween.

3. The variable nozzle turbocharger of claim 2, wherein each of the variable nozzles has a second fit-engagement portion engaged with each of the second fit-engagement groove so that the second fit-engagement portion is rotatable and movable in the radial direction of the unison ring along the second fit-engagement groove, and wherein the second fit-engagement portion has a closing side contact surface of a convex arcuate shape that is able to contact the closing side surface of the second fit-engagement groove.

* * * * *